US009140098B2

(12) United States Patent
Getzlaf et al.

(10) Patent No.: US 9,140,098 B2
(45) Date of Patent: Sep. 22, 2015

(54) DOWNHOLE ISOLATION AND DEPRESSURIZATION TOOL

(71) Applicant: NCS OILFIELD SERVICES CANADA INC., Alberta, Calgary (CA)

(72) Inventors: Donald Getzlaf, Calgary (CA); Marty Stromquist, Calgary (CA); John Edward Ravensbergen, Dewinton (CA); Lyle Laun, Calgary (CA); Eric Schmelzl, Calgary (CA)

(73) Assignee: NCS Multistage, LLC (CA)

( * ) Notice: Subject to any disclaimer, the term of this patent is extended or adjusted under 35 U.S.C. 154(b) by 0 days.

(21) Appl. No.: 14/559,567

(22) Filed: Dec. 3, 2014

(65) Prior Publication Data

US 2015/0075809 A1 Mar. 19, 2015

Related U.S. Application Data

(63) Continuation of application No. 13/709,908, filed on Dec. 10, 2012, now Pat. No. 8,931,559.

(60) Provisional application No. 61/615,035, filed on Mar. 23, 2012.

(51) Int. Cl.

| | |
|---|---|
| ***E21B 34/14*** | (2006.01) |
| ***E21B 34/06*** | (2006.01) |
| ***E21B 21/10*** | (2006.01) |

(Continued)

(52) U.S. Cl.

CPC ..... *E21B 34/14* (2013.01); *E21B 17/1078* (2013.01); *E21B 21/103* (2013.01); *E21B 33/126* (2013.01); *E21B 33/146* (2013.01); *E21B 34/06* (2013.01); *E21B 34/063* (2013.01)

(58) Field of Classification Search

CPC ..... E21B 21/103; E21B 4/106; E21B 34/063; E21B 33/146; E21B 17/10; E21B 17/1078; E21B 34/06; E21B 34/14; E21B 33/126

See application file for complete search history.

(56) References Cited

U.S. PATENT DOCUMENTS

| | | | |
|---|---|---|---|
| 2,034,768 | A | 3/1936 | O'Neill |
| 2,212,743 | A | 8/1940 | Kremmling |

(Continued)

FOREIGN PATENT DOCUMENTS

| | | |
|---|---|---|
| CA | 1081608 | 7/1980 |
| CA | 1147643 | 6/1983 |

(Continued)

OTHER PUBLICATIONS

Baker Oil Tools Catalogue 2002.

(Continued)

*Primary Examiner* — Yong-Suk (Philip) Ro

(74) *Attorney, Agent, or Firm* — Blank Rome, LLP

(57) ABSTRACT

A depressurization tool is described for use downhole in depressurizing an isolated zone. A decompression chamber containing a compressible fluid volume is described. The opening of the chamber is sealed with a closure that is configured to open upon application of a pressure differential across the opening. When used downhole within an isolated and nonpermeable wellbore zone, excessive ambient pressure will cause the closure to open and allow the chamber to fill with fluid at increased pressure, depressurizing the wellbore zone. The tool is useful in wellbore completion systems that include sliding sleeves.

6 Claims, 9 Drawing Sheets

(51) Int. Cl.

| | |
|---|---|
| ***E21B 33/14*** | (2006.01) |
| ***E21B 17/10*** | (2006.01) |
| ***E21B 33/126*** | (2006.01) |

(56) References Cited

U.S. PATENT DOCUMENTS

| | | | |
|---|---|---|---|
| 2,458,433 | A | 1/1949 | Arterbury et al. |
| 2,624,409 | A | 1/1953 | O'Neill |
| 2,670,218 | A | 2/1954 | Rokar |
| 2,683,432 | A | 7/1954 | Schanz |
| 2,766,014 | A | 10/1956 | Hanson |
| 2,769,497 | A | 11/1956 | Reistle, Jr. |
| 2,881,839 | A | 4/1959 | Wright et al. |
| 2,906,339 | A | 9/1959 | Griffin |
| 2,929,713 | A | 3/1960 | Bickoff |
| 2,929,714 | A | 3/1960 | Witte et al. |
| 2,969,841 | A | 1/1961 | Thomas |
| 2,986,214 | A | 5/1961 | Wiseman, Jr. et al. |
| 3,032,111 | A | 5/1962 | Corley |
| 3,118,501 | A | 1/1964 | Kenley |
| 3,228,210 | A | 1/1966 | Pam et al. |
| 3,273,649 | A | 9/1966 | Moody et al. |
| 3,381,749 | A | 5/1968 | Chenoweth |
| 3,417,827 | A | 12/1968 | Smith et al. |
| 3,430,701 | A | 3/1969 | Canada |
| 3,433,305 | A | 3/1969 | Bell |
| 3,447,607 | A | 6/1969 | Harris et al. |
| 3,463,248 | A | 8/1969 | Chaffee et al. |
| 3,507,325 | A | 4/1970 | Scott |
| 3,648,777 | A | 3/1972 | Arterbury et al. |
| 3,845,818 | A | 11/1974 | Denton |
| 3,878,889 | A | 4/1975 | Seabourn |
| 3,895,678 | A | 7/1975 | Wright et al. |
| 4,047,569 | A | 9/1977 | Tagirov et al. |
| 4,071,096 | A | 1/1978 | Dines |
| 4,194,561 | A | 3/1980 | Stokley et al. |
| 4,257,484 | A | 3/1981 | Whitley et al. |
| 4,287,952 | A | 9/1981 | Erbstoesser |
| 4,312,406 | A | 1/1982 | McLaurin et al. |
| 4,346,761 | A | 8/1982 | Skinner et al. |
| 4,366,861 | A | 1/1983 | Milam |
| 4,421,182 | A | 12/1983 | Moody et al. |
| 4,427,060 | A | 1/1984 | Villers |
| 4,427,070 | A | 1/1984 | O'Brien |
| 4,470,464 | A | 9/1984 | Baldenko et al. |
| 4,501,331 | A | 2/1985 | Brieger |
| RE31,842 | E | 3/1985 | Weitz |
| 4,523,643 | A | 6/1985 | McGlothen |
| 4,619,323 | A | 10/1986 | Gidley |
| 4,637,468 | A | 1/1987 | Derrick |
| 4,733,723 | A | 3/1988 | Callegari, Sr. |
| 4,804,042 | A | 2/1989 | Knight |
| 4,834,183 | A | 5/1989 | Vinzant et al. |
| 4,881,599 | A | 11/1989 | Franco et al. |
| 4,889,199 | A | 12/1989 | Lee |
| 4,917,187 | A | 4/1990 | Burns et al. |
| 4,940,094 | A | 7/1990 | Lessi et al. |
| 4,953,617 | A | 9/1990 | Ross et al. |
| 5,033,551 | A | 7/1991 | Grantom |
| 5,117,910 | A | 6/1992 | Brandell et al. |
| 5,127,472 | A | 7/1992 | Watson et al. |
| 5,314,015 | A | 5/1994 | Streich |
| 5,316,086 | A | 5/1994 | DeMoss |
| 5,318,123 | A | 6/1994 | Venditto et al. |
| 5,353,875 | A | 10/1994 | Schultz et al. |
| 5,358,048 | A | 10/1994 | Brooks |
| 5,417,291 | A | 5/1995 | Leising |
| 5,435,395 | A | 7/1995 | Connell |
| 5,472,049 | A | 12/1995 | Chaffee et al. |
| 5,474,130 | A | 12/1995 | Davis |
| 5,499,687 | A | 3/1996 | Lee |
| 5,513,703 | A | 5/1996 | Mills et al. |
| 5,638,904 | A | 6/1997 | Misselbrook et al. |
| 5,653,286 | A | 8/1997 | McCoy et al. |
| 5,704,426 | A | 1/1998 | Rytlewski et al. |
| 5,711,372 | A | 1/1998 | Stokley |
| 5,755,286 | A | 5/1998 | Ebinger |
| 5,765,642 | A | 6/1998 | Surjaatmadia |
| 5,799,732 | A | 9/1998 | Gonzalez et al. |
| 5,813,456 | A | 9/1998 | Milner |
| 5,842,521 | A | 12/1998 | Tetzlaff et al. |
| 5,890,536 | A | 4/1999 | Nierode et al. |
| 5,934,377 | A | 8/1999 | Savage |
| 5,947,200 | A | 9/1999 | Montgomery |
| 5,954,133 | A | 9/1999 | Ross |
| 6,024,173 | A | 2/2000 | Patel et al. |
| 6,116,343 | A | 9/2000 | Van Petegem et al. |
| 6,142,231 | A | 11/2000 | Myers, Jr. et al. |
| 6,186,227 | B1 | 2/2001 | Vaynshteyn et al. |
| 6,244,351 | B1 | 6/2001 | Patel |
| 6,273,195 | B1 | 8/2001 | Hauck et al. |
| 6,286,598 | B1 | 9/2001 | van Petegem et al. |
| 6,286,660 | B1 | 9/2001 | Kaim |
| 6,289,990 | B1 | 9/2001 | Dillon et al. |
| 6,293,346 | B1 | 9/2001 | Patel |
| 6,364,017 | B1 | 4/2002 | Stout et al. |
| 6,394,184 | B2 | 5/2002 | Toiman et al. |
| 6,427,773 | B1 | 8/2002 | Albers |
| 6,460,619 | B1 | 10/2002 | Braithwaite et al. |
| 6,474,419 | B2 | 11/2002 | Naier et al. |
| 6,491,098 | B1 | 12/2002 | Dallas |
| 6,497,290 | B1 | 12/2002 | Misselbrook et al. |
| 6,513,595 | B1 | 2/2003 | Freiheit et al. |
| 6,516,595 | B2 | 2/2003 | Rhody et al. |
| 6,520,255 | B2 | 2/2003 | Tolman et al. |
| 6,543,538 | B2 | 4/2003 | Tolman et al. |
| 6,575,247 | B2 | 6/2003 | Tolman et al. |
| 6,672,405 | B2 | 1/2004 | Tolman et al. |
| 6,675,898 | B2 | 1/2004 | Staudt |
| 6,695,057 | B2 | 2/2004 | Ingram et al. |
| 6,732,793 | B1 | 5/2004 | Lee |
| 6,763,892 | B2 | 7/2004 | Kaszuba |
| 6,772,847 | B2 | 8/2004 | Rae et al. |
| 6,810,958 | B2 | 11/2004 | Szaeka et al. |
| 6,840,323 | B2 | 1/2005 | Fenton |
| 6,907,936 | B2 | 6/2005 | Fehr et al. |
| 6,915,856 | B2 | 7/2005 | Gentry et al. |
| 6,923,255 | B2 | 8/2005 | Lee |
| 6,949,491 | B2 | 9/2005 | Cooke |
| 6,957,701 | B2 | 10/2005 | Tolman et al. |
| 7,051,812 | B2 | 5/2006 | McKee et al. |
| 7,059,407 | B2 | 6/2006 | Tolman |
| 7,066,264 | B2 | 6/2006 | Bissonnette et al. |
| 7,066,266 | B2 | 6/2006 | Wilkinson |
| 7,104,652 | B2 | 9/2006 | Kojima |
| 7,108,067 | B2 | 9/2006 | Themig et al. |
| 7,121,337 | B2 | 10/2006 | Cook et al. |
| 7,134,505 | B2 | 11/2006 | Fehr et al. |
| 7,165,611 | B2 | 1/2007 | Jones |
| 7,191,830 | B2 | 3/2007 | McVay |
| 7,213,654 | B2 | 5/2007 | Plucheck et al. |
| 7,225,869 | B2 | 6/2007 | Willett et al. |
| 7,278,486 | B2 | 10/2007 | Alba et al. |
| 7,284,619 | B2 | 10/2007 | Stokley et al. |
| 7,287,596 | B2 | 10/2007 | Frazier et al. |
| 7,325,617 | B2 | 2/2008 | Murray |
| 7,343,975 | B2 | 3/2008 | Surjaatmadja et al. |
| 7,347,288 | B2 | 3/2008 | Lee |
| 7,357,151 | B2 | 4/2008 | Lonnes |
| 7,416,029 | B2 | 8/2008 | Telfer et al. |
| 7,441,595 | B2 | 10/2008 | Jelsma |
| 7,467,778 | B2 | 12/2008 | Lonnes |
| 7,472,746 | B2 | 1/2009 | Maier |
| 7,510,017 | B2 | 3/2009 | Howell et al. |
| 7,516,792 | B2 | 4/2009 | Lonnes et al. |
| 7,520,333 | B2 | 4/2009 | Turner et al. |
| 7,556,102 | B2 | 7/2009 | Gomez |
| 7,789,163 | B2 | 9/2010 | Kratochvil et al. |
| 7,849,924 | B2 | 12/2010 | Surjaatmadja et al. |
| 7,896,082 | B2 | 3/2011 | Lake et al. |
| 7,913,770 | B2 | 3/2011 | Schramm et al. |
| 8,016,032 | B2 | 9/2011 | Mandrell et al. |
| 8,066,074 | B2 | 11/2011 | Maskos et al. |
| D657,807 | S | 4/2012 | Frazier |

(56) References Cited

U.S. PATENT DOCUMENTS

| | | | | |
|---|---|---|---|---|
| 8,210,267 | B2 | 7/2012 | Avant | |
| 2002/0162660 | A1 | 11/2002 | Depiak et al. | |
| 2003/0121663 | A1 | 7/2003 | Weng et al. | |
| 2004/0206504 | A1 | 10/2004 | Rosato | |
| 2005/0056429 | A1 | 3/2005 | Du et al. | |
| 2005/0072527 | A1 | 4/2005 | Gunji et al. | |
| 2005/0072577 | A1 | 4/2005 | Freeman | |
| 2005/0150661 | A1 | 7/2005 | Kenison et al. | |
| 2005/0178551 | A1 | 8/2005 | Tolman et al. | |
| 2005/0236154 | A1 | 10/2005 | Tudor et al. | |
| 2006/0000620 | A1 | 1/2006 | Hamilton | |
| 2006/0108117 | A1 | 5/2006 | Telfer | |
| 2006/0124310 | A1 | 6/2006 | Lopez de Cardenas et al. | |
| 2006/0180319 | A1 | 8/2006 | Lucas et al. | |
| 2006/0243435 | A1* | 11/2006 | Faul | 166/241.1 |
| 2006/0243456 | A1 | 11/2006 | Faul | |
| 2007/0062690 | A1 | 3/2007 | Witcher | |
| 2007/0199717 | A1 | 8/2007 | Swoyer et al. | |
| 2007/0272410 | A1 | 11/2007 | Hromas et al. | |
| 2007/0272411 | A1 | 11/2007 | Lopez De Cardenas et al. | |
| 2008/0066917 | A1 | 3/2008 | Lehr et al. | |
| 2008/0142219 | A1 | 6/2008 | Steele et al. | |
| 2008/0179060 | A1 | 7/2008 | Surjaatmadja et al. | |
| 2008/0202755 | A1 | 8/2008 | Henke et al. | |
| 2008/0314591 | A1 | 12/2008 | Hales et al. | |
| 2008/0314600 | A1 | 12/2008 | Howard et al. | |
| 2009/0044944 | A1 | 2/2009 | Murray et al. | |
| 2009/0107680 | A1 | 4/2009 | Surjaatmadja | |
| 2009/0159299 | A1 | 6/2009 | Kratochvil et al. | |
| 2009/0242211 | A1 | 10/2009 | Fagley et al. | |
| 2009/0294124 | A1 | 12/2009 | Patel | |
| 2010/0108276 | A1 | 5/2010 | Kuwahara et al. | |
| 2010/0108323 | A1 | 5/2010 | Wilkin | |
| 2011/0061856 | A1 | 3/2011 | Kellner et al. | |
| 2011/0100643 | A1* | 5/2011 | Themig et al. | 166/373 |
| 2011/0155377 | A1* | 6/2011 | Laun | 166/308.1 |
| 2011/0174491 | A1 | 7/2011 | Ravensbergen et al. | |
| 2011/0198082 | A1 | 8/2011 | Stromquist et al. | |
| 2011/0290486 | A1 | 12/2011 | Howard et al. | |
| 2011/0308817 | A1 | 12/2011 | Ravensbergen | |
| 2012/0055670 | A1 | 3/2012 | Armstrong | |
| 2012/0061103 | A1 | 3/2012 | Hurtado et al. | |
| 2012/0086802 | A1 | 4/2012 | Eng et al. | |
| 2012/0090847 | A1 | 4/2012 | Getzlaf et al. | |
| 2012/0125619 | A1 | 5/2012 | Wood et al. | |
| 2012/0186802 | A1 | 7/2012 | Howard et al. | |
| 2013/0292133 | A1* | 11/2013 | Thompson | 166/373 |

FOREIGN PATENT DOCUMENTS

| | | | |
|---|---|---|---|
| CA | 1163554 | A1 | 3/1984 |
| CA | 1210686 | | 9/1986 |
| CA | 1298779 | | 4/1992 |
| CA | 2121636 | A1 | 10/1994 |
| CA | 2133818 | A1 | 4/1995 |
| CA | 2212743 | A1 | 6/1997 |
| CA | 2381360 | | 1/2001 |
| CA | 2397460 | A1 | 8/2001 |
| CA | 2497463 | | 3/2004 |
| CA | 2458433 | A1 | 8/2004 |
| CA | 2167491 | | 2/2005 |
| CA | 2249432 | | 9/2005 |
| CA | 2320949 | | 5/2006 |
| CA | 2618277 | A1 | 3/2007 |
| CA | 2416040 | A1 | 9/2008 |
| CA | 2639341 | A1 | 3/2009 |
| CA | 2701700 | | 4/2009 |
| CA | 2743164 | | 5/2010 |
| CA | 2693676 | A1 | 7/2010 |
| CA | 2749636 | A1 | 7/2010 |
| CA | 2711329 | A1 | 1/2011 |
| CA | 2730695 | A1 | 4/2011 |
| CA | 2738907 | A1 | 7/2011 |
| CA | 2766026 | A1 | 7/2011 |
| CA | 2781721 | A1 | 9/2012 |
| EP | 589687 | A2 | 3/1994 |
| EP | 2105577 | A1 | 9/2009 |
| GB | 2356879 | A | 6/2001 |
| GB | 2403968 | A | 1/2005 |
| SU | 926238 | A1 | 5/1982 |
| WO | 9625583 | A1 | 8/1996 |
| WO | 9735093 | A1 | 9/1997 |
| WO | 02068793 | | 9/2002 |
| WO | 03015025 | A2 | 2/2003 |
| WO | 2008091345 | A1 | 7/2008 |
| WO | 2008093047 | A1 | 8/2008 |
| WO | 2009068302 | A2 | 6/2009 |
| WO | 2011116207 | A1 | 9/2011 |
| WO | 2011133810 | A2 | 10/2011 |
| WO | 2012027831 | A1 | 3/2012 |
| WO | 2012051705 | A1 | 4/2012 |
| WO | 2012014574 | A2 | 8/2012 |

OTHER PUBLICATIONS

Tools International Corporation Catalogue 2008.
"Sand Jet Perforating Revisited," SPE Drill & Completion, vol. 14, No. 1 Mar. 1999, J.S. Cobbett, pp. 28-33.
"Tubing-Conveyed Perforating With Hydraulic Set Packers and a New High-Pressure Retrievable Hydraulic Packer" SPE 13372, Hailey and Donovan 1984.
"Advances in Sand Jet Perforating", SPE 123569, Dotson, Far and Findley, 2009, pp. 1-7.
"High-Pressure/High-Temperature Coiled Tubing Casing Collar Locator Provides Accurate Depth Control for Single Trip Perforating" SPE 60698, Connell et al. 2000, pp. 1-9.
"Investigation of Abrasive-Laden-Fluid Method for Perforation and Fracture Initiation" Journal of Petroleum Technology, Pittman, Harriman and St. John, 1961, pp. 489-495.
"Sand Jet Perforating Revisited" SPE 39597, Cobbett 1998, pp. 703-715.
"Single-Trip Completion Concpt Replaces Multiple Packers and Sliding Sleeves in Selective Multi-Zone Production and Stimulation Operations" SPE 29539, Coon and Murray 1995, pp. 911-915.
International Search Report for application PCT/CA2011/001167 dated Feb. 8, 2012.
"Z-Frac Straddle Packer" brochure information (3 pages), Feb. 2009.
Innicor Tool Information (3 pages), Sep. 15, 2006.
Canadian Office Action for Serial No. 2,693,676 dated Jun. 16, 2011.
Canadian Office Action for Serial No. 2,693,676 dated Oct. 19, 2010.
Publication "Sand Jet Perforating Revisited", J.S. Cobbett, SPE Drills & Completion 14(1), Mar. 1999, pp. 28-33.
International Search Report for Application PCT/CA2011/000988 mailed Oct. 17, 2011.
Office Action dated Jan. 17, 2011 from Canadian Intellectual Property Office for Serial No. 2,713,611.
Accuracy and Reliability of coiled tubing Depth Measurement (SPE38422) Pessin, J-L, et al. 1997.
Development of a Wireless Coiled Tubing Collar Locator (SPE54327) Connell, Michael L., et al., 1999.

* cited by examiner

DOWNHOLE ISOLATION AND DEPRESSURIZATION TOOL

CROSS-REFERENCE TO RELATED APPLICATIONS

This application is a continuation of U.S. patent application Ser. No. 13/709,908 filed on Dec. 10, 2012, which claims the benefit of U.S. Provisional Application No. 61/615,035 filed on Mar. 23, 2012, which are incorporated by reference in their entirety herein.

STATEMENT REGARDING FEDERALLY SPONSORED RESEARCH OR DEVELOPMENT

Not Applicable.

BACKGROUND OF THE INVENTION

1. Field of the Invention

The invention relates generally to systems and methods for relieving annulus pressure within an isolated zone of a well.

2. Description of the Related Art including information disclosed under 37 CFR 1.97 and 1.98

In downhole operations, it is common to treat various segments of the wellbore independently. For example, cementing casing within the wellbore may be completed in various stages, using isolation equipment and valves to direct cement about the casing annulus in successive segments. Similarly, in completion operations, various zones of the well bore may be perforated independently and treated independently.

Wellbore zones are commonly isolated by strategic placement of bridge plugs, cup seals, inflatable sealing elements, and compressible elements, which may be appropriately positioned either inside a cemented casing, or outside an uncemented liner.

Various means to provide isolated access to the formation are known, which commonly include perforation of the casing or liner, or by otherwise providing ports within the liner. Within an isolated zone, the hydraulic pressure about the tool string may fluctuate based on the treatment being applied to the zone. In some operations, it may be desirable to quickly dissipate the annulus pressure when a certain threshold of pressure is reached.

SUMMARY

Generally, a method and device for use in dissipating annulus pressure within an isolated and non-permeable portion of a wellbore is provided.

Other aspects and features of the present invention will become apparent to those ordinarily skilled in the art upon review of the following description in conjunction with the accompanying figures, and the appended claims.

In general, according to one aspect, there is provided a system for use in dissipating pressure in a wellbore, the system comprising: a) a housing operatively connected between two casing tubulars of a casing string, the housing including a lateral port defined therethrough; b) a sliding sleeve associated with the housing, the sliding sleeve being moveable from a first position wherein the sleeve prevents fluid communication from the annulus defined between a tool string and the casing through the port to a second position wherein fluid communication through the port is permitted; and c) a tool string comprising: at least one sealing element adapted to provide a seal between the tool string and the sliding sleeve; and a decompression chamber disposed on the tool string below the sealing element, the chamber defining a hollow interior and having an opening for admitting fluid from the annulus into the interior of the chamber, the opening being sealed by a closure to sealingly isolate the chamber from the annular fluid between the casing string and the tool string, the closure being releasable upon application of a pressure differential across the closure, and wherein the movement of the fluid into the chamber permits actuation of the sleeve from the first position to the second position.

In general, according to another aspect, there is provided a downhole tool assembly for dissipating pressure in a wellbore, the assembly comprising: a) a decompression chamber having an upper end and a lower end and being adapted to be connected to a tool string, the chamber defining a hollow interior and having an opening for admitting fluid from an annulus defined between the wellbore and tool string into the interior of the chamber, the opening being sealed by a closure to sealingly isolate the chamber from the annulus defined between the wellbore and the tool string, the closure being releasable in response to a predetermined annular fluid pressure between the tool string and the wellbore; b) a crossover connected to the lower end of the decompression chamber and defining an inner volume which is continuous with the inner volume of the decompression chamber; c) a centralizer connected to the crossover, the crossover defining an interior volume and being fluidically continuous with the interior of the decompression chamber and the crossover; and d) a connector for connecting the upper end of the decompression chamber with the tubing string, wherein the connector prevents fluid communication from the upper end of the tubing string to the decompression chamber.

In general, according to another aspect, there is provided a method for dissipating hydraulic pressure within an isolated zone of a wellbore, the method comprising: deploying a tool string into a wellbore, the tool string comprising a sealing device disposed on the tool string and a decompression chamber disposed on the tool string below the sealing device, the decompression chamber defining a hollow interior and including an opening, the opening being sealed by a closure which is releasable upon application of a threshold pressure differential across the closure; lowering the tool string within a wellbore to locate the decompression chamber within a wellbore segment; actuating the sealing device to hydraulically seal the wellbore region below the sealing device from the wellbore region above the sealing device and thereby form an isolated zone below the sealing device; effecting a wellbore operation while the isolated zone remains hydraulically isolated, the wellbore operation comprising the step of raising the hydraulic pressure within the isolated zone such that the threshold pressure across the closure of the decompression chamber is exceeded and the closure is released; and collecting wellbore fluid from the isolated zone within the decompression chamber, thereby reducing the hydraulic pressure within the isolated zone.

In general, according to another aspect, there is provided a method for actuating a sliding sleeve located in a bottom region of a wellbore, the method comprising: positioning a casing string comprising a housing having at least one port and an inner sliding sleeve disposed within the housing, the sliding sleeve actuable to slide between a first position in which it is disposed over the port to a second position in which the port is not covered by the sleeve; deploying a downhole assembly into the casing string, the downhole assembly comprising a decompression chamber defining a hollow interior and having a closure positioned over an opening to the interior of the chamber, the closure configured to open upon application of a pressure differential across the closure; and a sealing element positioned above the decompression chamber; setting the sealing element so as to provide a seal between the sleeve and the casing string; delivering fluid to the wellbore above the sealing element, thereby creating a pressure differential across the closure sufficient to open the closure; dissipating wellbore fluid pressure in the annulus below the sealing element by movement of the annular fluid to the interior of the decompression chamber; and maintaining the fluid delivery to the wellbore annulus to allow the sleeve to slide from the first position to the second position.

BRIEF DESCRIPTION OF THE DRAWINGS

Embodiments of the present invention will now be described, by way of example only, with reference to the attached Figures, wherein.

DETAILED DESCRIPTION

Generally, the present disclosure provides a method and system for dissipating hydraulic pressure in an isolated wellbore interval. A depressurization tool for attachment to a tool string is provided. The depressurization tool includes a decompression chamber having a sealed opening. The seal may be provided by a valve, burst disc or other rupturable closure or a thinned-wall or other pressure-actuated closure. Upon exposure to excessive hydraulic pressure within the isolated wellbore, the seal on the opening will be released, allowing fluid to enter the interior of the chamber and thereby reduce the hydraulic pressure in the wellbore annulus defined between the wellbore and the tool string in the isolated interval. As will be discussed below, the method and system have particular use in systems that include casing strings with ported tubulars and that have sliding sleeves actuable to open and close the ports present in the ported tubulars.

Depressurization System

Figure 1:
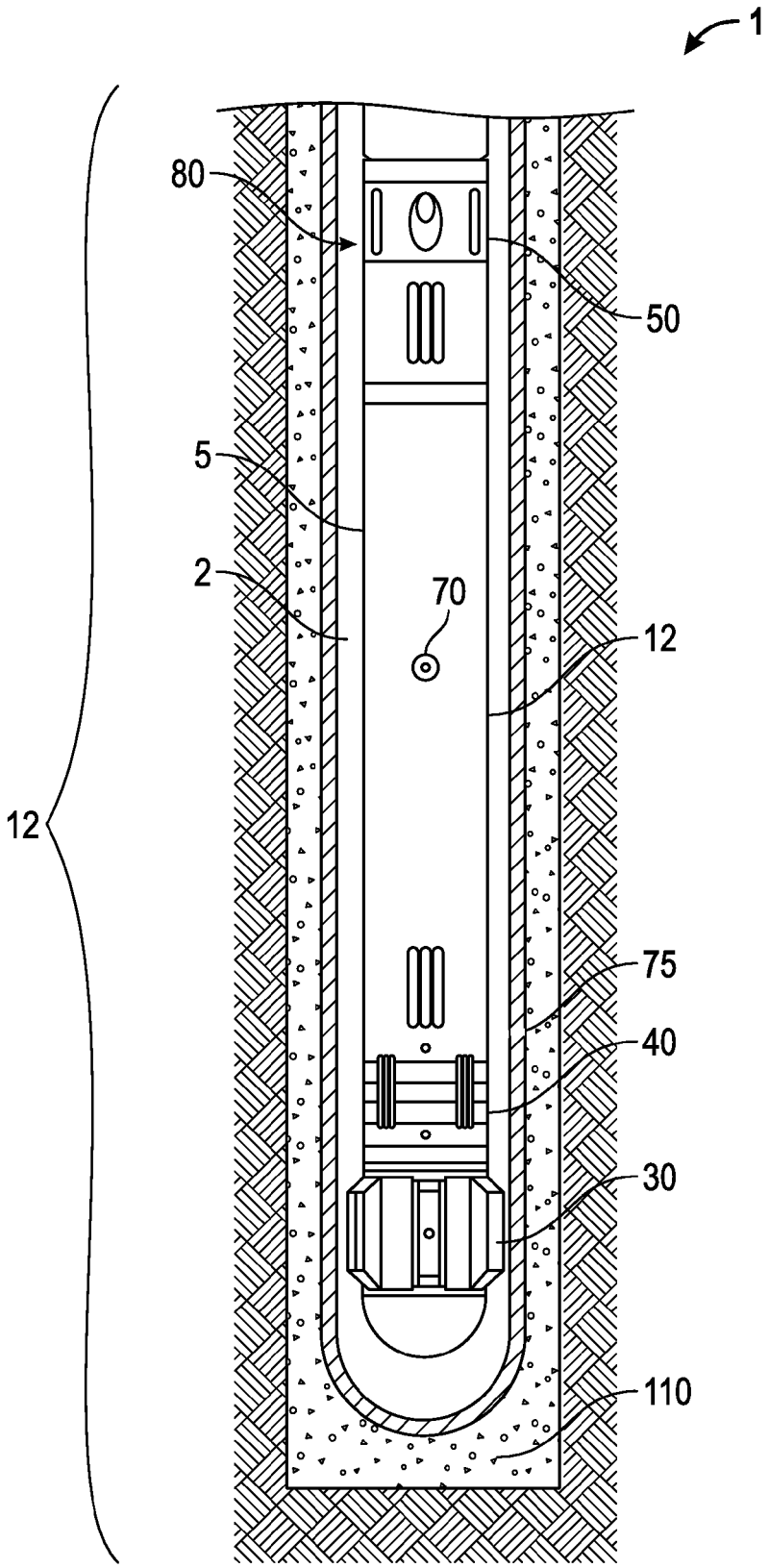
FIG. 1 illustrates a schematic sectional view of a depressurization system for dissipating pressure in an isolated wellbore interval, according to one embodiment.

As shown in FIG. 1, a system 1 for dissipating pressure in wellbore is disclosed. The system 1 includes a depressurization tool 5 deployed within a wellbore 12. Depressurization tool 5 may be deployed on a tool string 80, of the type which is more completely illustrated in FIG. 4. The wellbore 12 may be a cased wellbore. An annulus 2 is defined between the casing 75 and the tool string 80.

Figure 2:
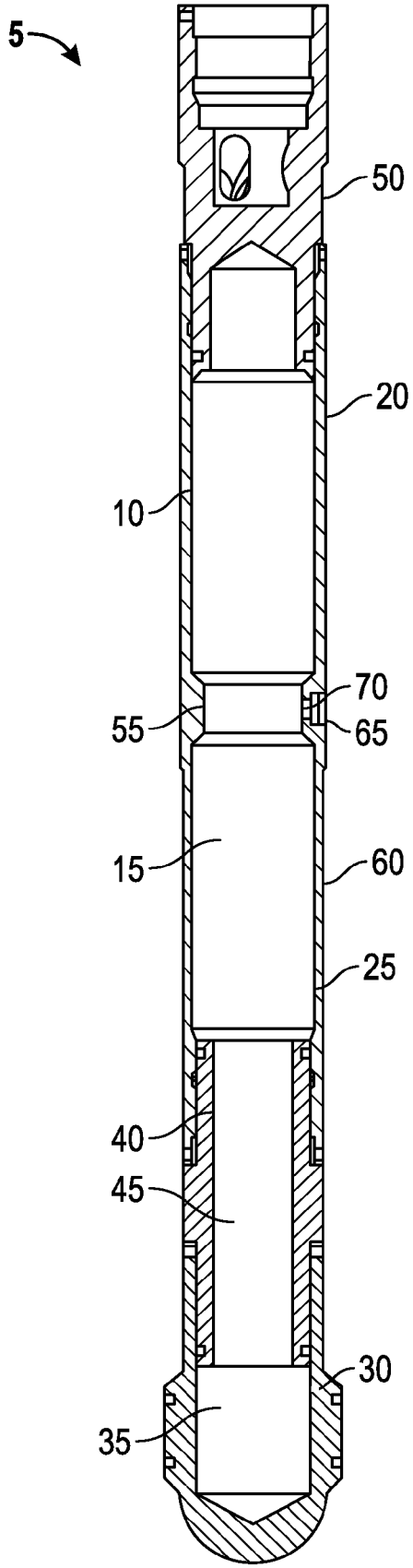
FIG. 2 illustrates a schematic cross sectional view of a depressurization tool, according to one embodiment.
Figure 3:
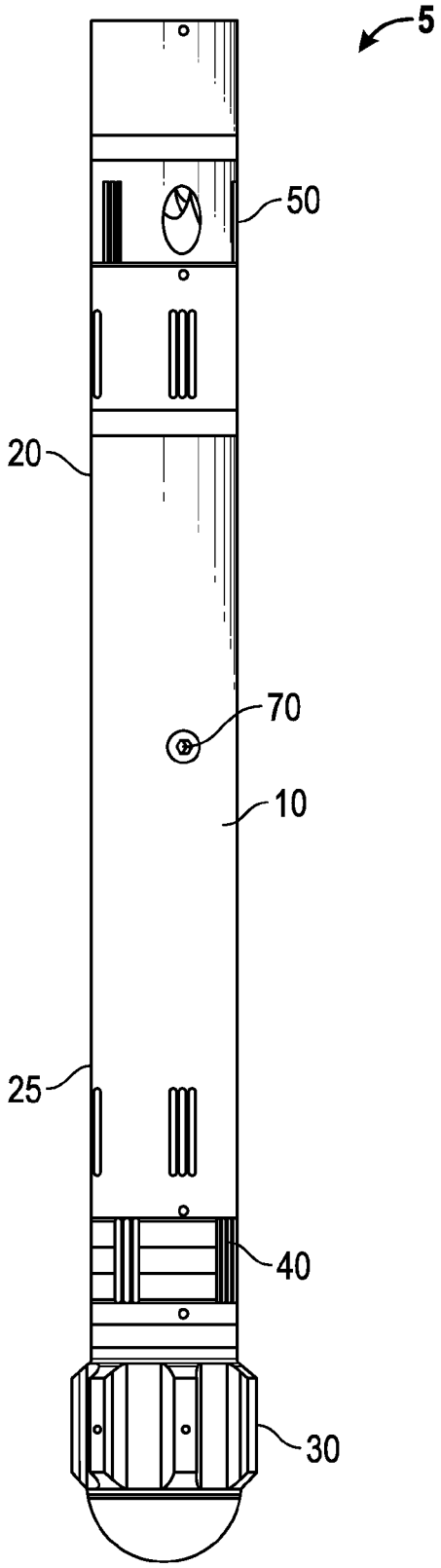
FIG. 3 illustrates a schematic perspective view of depressurization tool, according to one embodiment.

With reference to FIGS. 2 and 3, an embodiment of a depressurization tool 5 is shown. The depressurization tool 5 includes a decompression chamber 10 which is substantially tubular and which defines a substantially hollow interior 15. The decompression chamber 10 is an atmospheric chamber. By "atmospheric chamber", it meant that when the chamber is sealed, the pressure inside the chamber is substantially less than the hydraulic pressure in the annular region outside the chamber. The decompression chamber 10 may be filled with a gas such as hydrogen.

The decompression chamber 10 has an upper end 20 and a lower end 25. The lower end 25 of decompression chamber 10 is threadably connectable to a crossover 40 which contains am internal volume 45 which is continuous with the internal volume 15 of chamber 10. The crossover 40 is connected to a bullnosed centralizer 30. The bullnosed centralizer 30 may also define an internal volume 35, the internal volume 35 of the bullnosed centralizer 30 being continuous with the internal volume 45 of the crossover 40.

Figure 4:
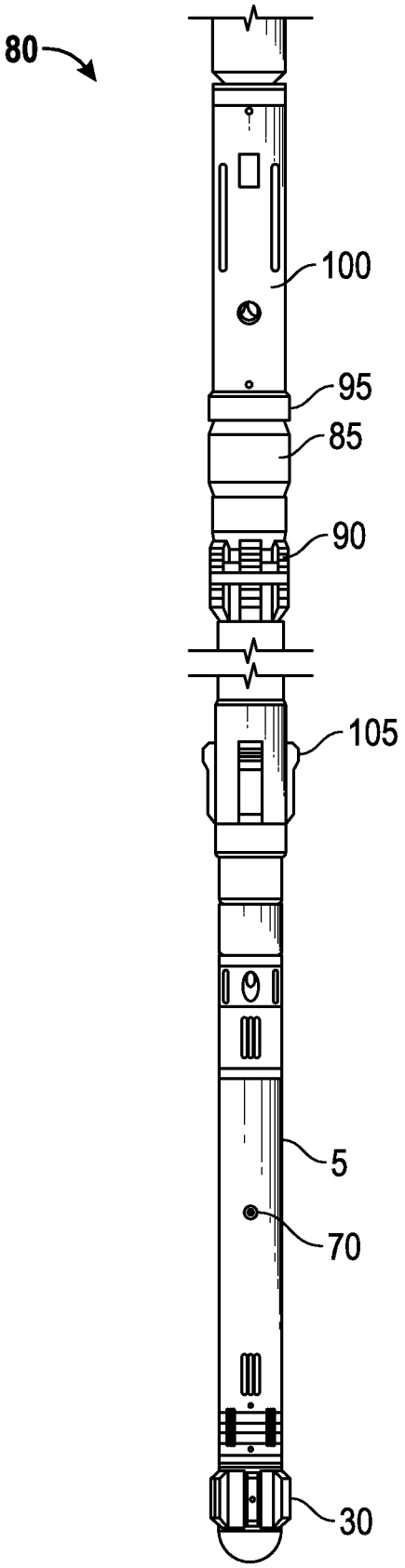
FIG. 4 illustrates a schematic cross sectional view of a tool string that includes the depressurization tool according to one embodiment.

The upper end 20 of the decompression chamber 10 is connectable to flow crossover 50. Flow crossover 50 connects the upper end of the depressurization tool 5 to tool string 80. For example, the flow crossover 50 may connect the depressurization tool 5 to a sub (meaning a tubular portion of the tool string) bearing the mechanical casing collar locator 105, as shown in FIG. 4. As a person skilled in the art would appreciate, other means of connecting the depressurization tool to the tool string are possible.

Generally, the decompression chamber 10 is impermeable to fluid flow from the annulus 2 unless a threshold hydraulic pressure is reached in the annulus surrounding the depressurization tool 5. Moreover, the decompression chamber 10 is generally restricted from receiving fluid flow from the tool string 80 above the depressurization tool 5. Accordingly, there is generally little fluid flow between the flow crossover 50 and the depressurization tool 5. This helps to ensure that the chamber is maintained at atmospheric pressure, or close thereto, when the chamber is sealed.

At least one opening 65 is defined in the wall 60 of the decompression chamber 10. The opening 65 is sealed by a burst disc 70. In the embodiment shown in the figures, the decompression chamber 10 includes a narrowing 55 that appears to divide the decompression chamber 10 into two subchambers. However, the decompression chamber 10 is fluidically continuous throughout its interior. The narrowing 55 has a thinner wall compared to wall 60 of the rest of the chamber 10. This thinner wall of the narrowing 55 allows for threading of a bust disc assembly into the wall. Alternate sealing closures will be apparent to those skilled in the art. For example, the opening 65 may be sealed with any closure that is releasable, removable, or otherwise rupturable or actuable upon exposure to a threshold ambient hydraulic pressure. Other suitable closures include a spring-biased ball valve, a sliding sleeve, a shear pin, a piston-mechanism, or a frangible wall portion, for example. Moreover, the burst disc assembly need not be threaded into the wall of the narrowing 55, but rather may be incorporated anywhere within the wall 60 of chamber 10.

The decompression chamber 10 includes an internal volume 15 at a predetermined pressure. For example, the decompression chamber 10 may contain air at atmospheric pressure. As the pressure range to which the decompression chamber 10 will be exposed downhole can typically be predicted, the burst disc 70 or other closure means over opening 65 can be selected or engineered to open when a predetermined threshold pressure is applied across the burst disc 70. The decompression chamber 10 therefore provides a receptacle to receive fluid from the annulus 2 of an isolated wellbore segment, as will be discussed below.

In some embodiments, removal of the closure (e.g. in the embodiment shown in the figures, rupture of the burst disc) from the opening 65 of the decompression chamber 10 and/or exposure to a continued or increased downhole ambient pressure may result in the actuation of further functions or operations within or about the decompression chamber 10. For example, the decompression chamber may telescopically, inflatably, or otherwise expand in volume to accommodate incoming fluid from the surrounding downhole environment, or may open a secondary fluid pathway within the tubing string to convey incoming fluid to another contained location within the tool string.

As an alternative, the closure may be designed to open upon exposure to an eroding chemical, such as an acid. For example, the closure may be composed of a material that is particularly susceptible to erosion by the chemical, while the remainder of the downhole equipment is either not susceptible or is less susceptible to erosion by the chemical. Accordingly, the chemical may be delivered to the decompression chamber, or to the wellbore region proximal to the decompression chamber prior to isolating the segment. After the wellbore is isolated, full erosion of the closure can occur prior to increasing pressure within the isolated segment, for example.

Tool String

As noted above, the depressurization tool 5 is adapted for connection within a tool string 80 for use downhole. Suitable tool string configurations for use with the depressurization tool are readily available. For example, the present Applicant has previously described downhole treatment assemblies in Canadian Patent 2,693,676, Canadian Patent 2,713,622, and Canadian Patent No. 2,738,907, the contents of which are herein incorporated by reference. The presently described depressurization tool may, for example, be attached to the lower end of such treatment assemblies to allow pressure dissipation as needed during completion operations. An example of a suitable tool string is discussed below.

Referring to FIG. 4, a tool string 80 includes depressurization tool 5. The tool string 80 includes a sealing element 85 for sealingly engaging the casing 75. In the embodiment shown in FIG. 4, the sealing element 85 is a compressible sealing element, which can be compressed radially outwardly to seal against the casing 75, thereby hydraulically isolating the annulus 2 above the sealing element 85 from the annulus below the sealing element 85.

In some embodiments, the tool string 80 may include one or more sealing elements. Other means to isolate an interval of a wellbore are possible. For example, the tool assembly may include a packer, sealing element, bridge plug, dart, ball, or any other suitable wellbore sealing device above the depressurization tool.

Mechanical slips 90 are present to stabilize the tool string 80 against the wellbore during setting of the sealing element 85. An actuation cone 95 for exerting pressure against the sealing element 85 in response to manipulation of the tool string 80 from surface is present. The tool string 80 may also include an equalization valve 100 for use in equalization of hydraulic pressure across the sealing element 85. Selective actuation of the actuation cone 95 to compress the sealing element 85 may, for example be operated using an auto J mechanism, as has been taught previously. Accordingly, the sealing element 85 can be operated by applying mechanical force to the tubing string 80, for example, by pushing, pulling, or otherwise manipulating the tool string 80 within the wellbore.

Figure 7A:
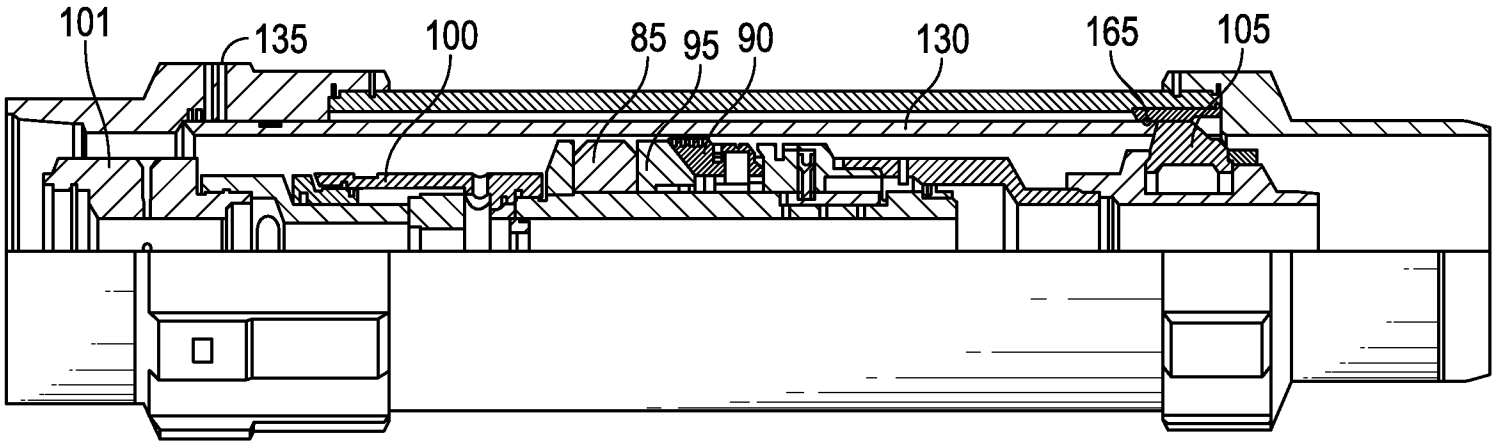
FIG. 7*a* illustrates a cross sectional view of a portion of the tool string of FIG. 4 disposed within the ported sub of FIG. 6*a* according to one embodiment.
Figure 7B:
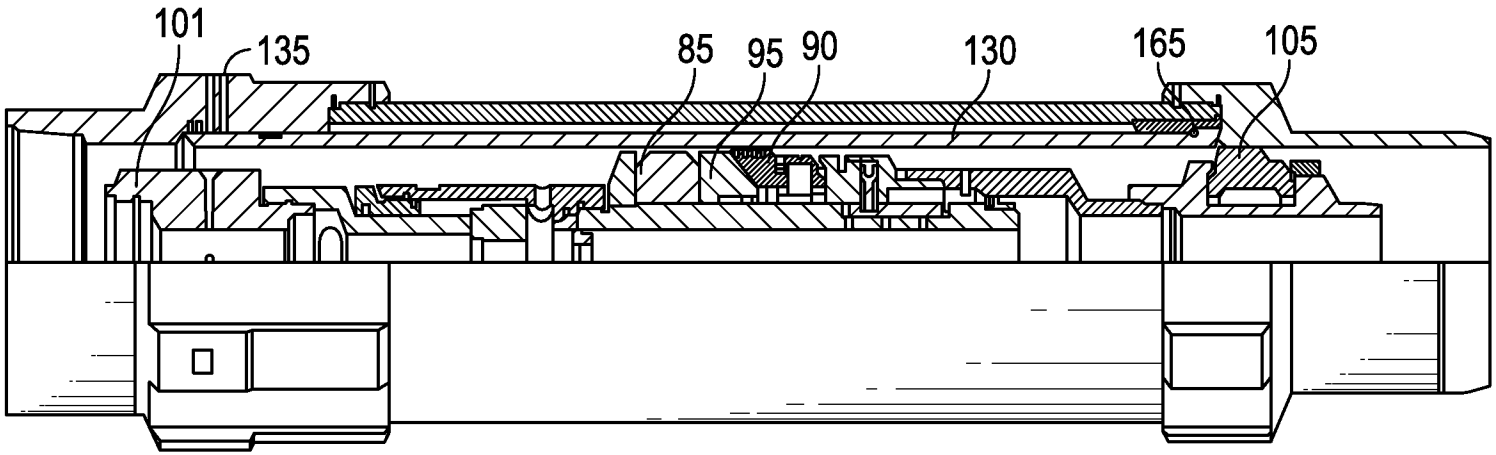
FIG. 7*b* illustrates a cross sectional view of a portion of the tool string of FIG. 4 disposed within the ported sub of FIG. 6*b* according to one embodiment.

The tool string 80 may also include a locator such as a mechanical collar locator 105 for locating the tool string 80 within the wellbore 12. The tool string may also include a fluid jetting assembly (not shown in FIG. 4; shown as 101 in FIGS. 7*a* and 7*b*).

Upon deployment downhole, the depressurization tool 5 may be positioned proximal to the toe 110 of the wellbore 12. The toe 110 defines the bottom region of the wellbore 12. Thus, depressurization tool 5 forms the lower end of tool string 80, and when tool string 80 is lowered in the wellbore, the depressurization tool 5 is close to the bottom of the wellbore. When the depressurization tool 5 is positioned at the toe 110 of the wellbore 12, the region between the sealing element 85 and the bottom of the wellbore 12 defines an interval that can be hydraulically isolated. By "hydraulically isolated", it is meant that the interval is relatively impermeable to fluid flow from the wellbore above the sealing element. The hydraulically isolated wellbore interval may be non-permeable, meaning that there are no ports or fluid passages that allow fluid communication to the wellbore interval. Thus, the annular fluid in the isolated interval will be pressurized.

In some embodiments, the decompression chamber may be attached directly to the first casing joint or below the first casing joint when the wellbore is lined. Alternatively, an independent decompression chamber could be lowered, dropped, or pumped to the toe of the well for later opening upon isolation of the lower end of the well.

The depressurization tool 5 may be deployed on tubing, wireline, or any other suitable system by which the tool may be lowered downhole. Also, various alternatives to deployment of the depressurization tool on tool string are possible. For example, the depressurization tool may be deployed on wireline below a plug, dart, or sealing ball that is intended to sealingly mate with a corresponding seat along the inner diameter of the wellbore. In such embodiments, the decompression chamber would be required to have a narrower outer diameter than that of the sealing element so as to pass through the corresponding seat.

Well Bore Completion System

The depressurization tool may be part of a wellbore completion system. Any suitable wellbore completion system may be used. As will be discussed, a wellbore completion system having a sliding sleeve is suitable because the depressurization tool can dissipate annular pressure in the wellbore region below the sleeve.

Figure 6A:
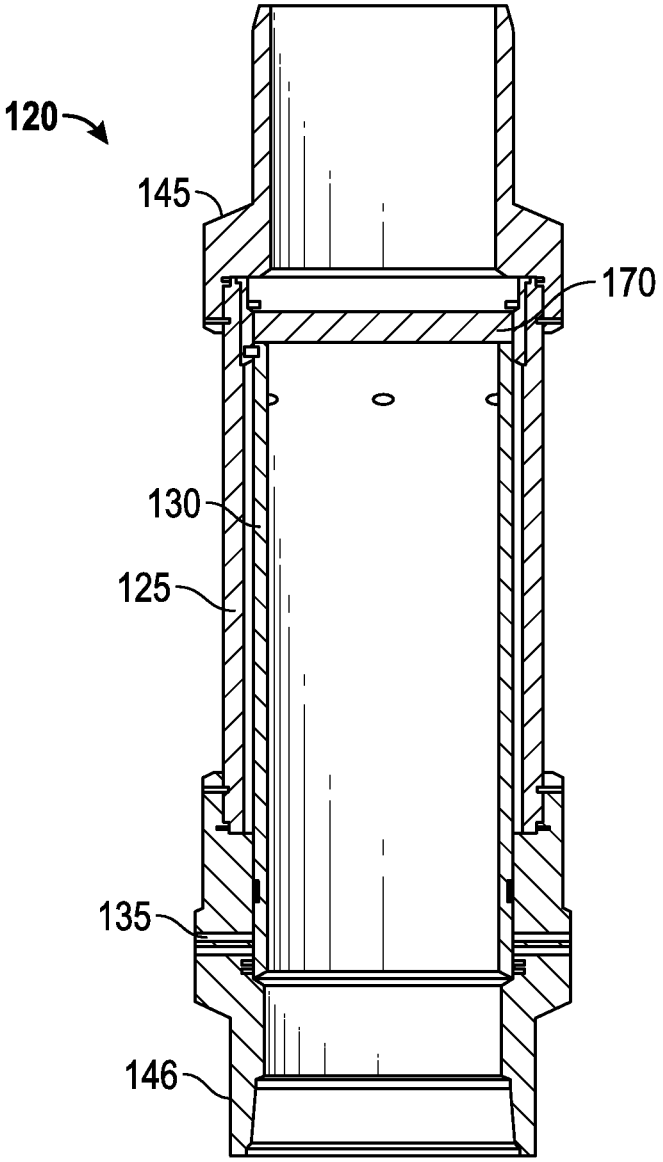
FIG. 6*a* illustrates a cross sectional view of a ported sub and a sliding sleeve, with the sliding sleeve in the port closed position according to one embodiment.
Figure 6B:
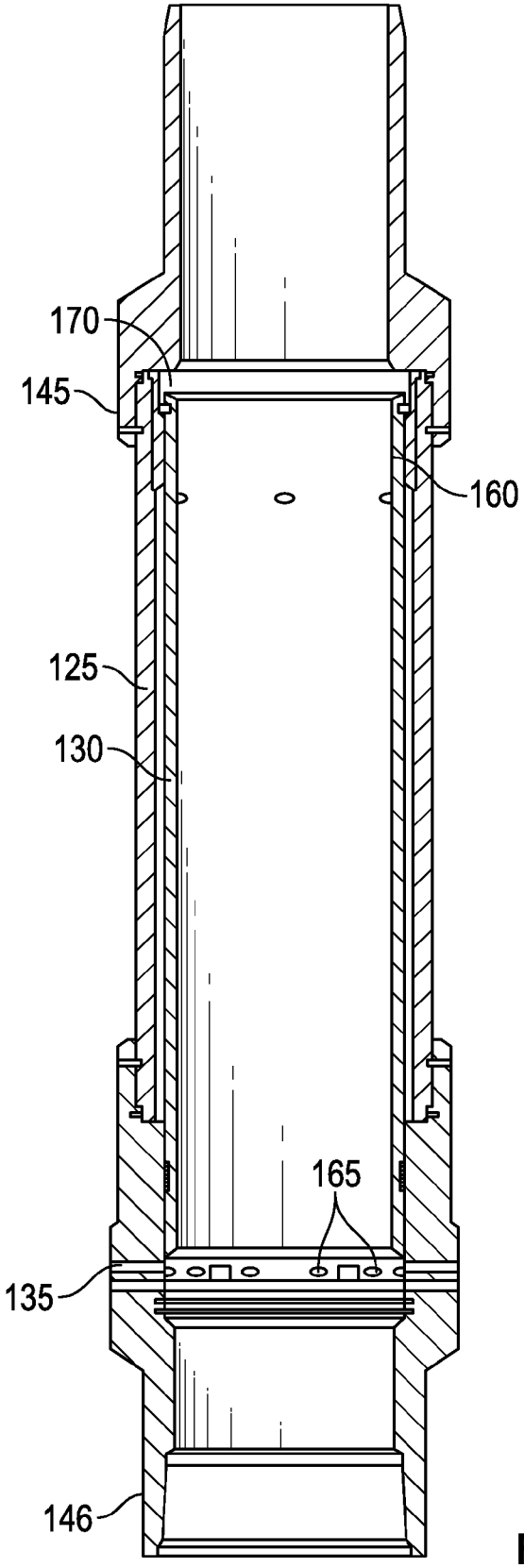
FIG. 6*b* illustrates a cross sectional view of a ported sub and a sliding sleeve, with the sliding sleeve in the port open position according to one embodiment.

As noted above, the tool string 80 may be deployed within a casing 75. The casing 75 may be made of multiple casing lengths, connected to each other by collars or casing connectors, for example. As shown in FIGS. 6*a* and 6*b*, ported sub 120 includes an outer housing 125. A sliding sleeve 130 is disposed within the outer housing 125. The outer housing 125 includes at least one port 135 defined therethrough. Port 135 is formed through outer housing 125, but not within sliding sleeve 130. The port 135 allows for fluid communication between the annulus (and the wellbore, when the casing is perforated) and the interior of the tool string 80, depending on whether the port is open (i.e. sleeve is not positioned over the port) or closed (i.e. sleeve is positioned over the port). Ported sub 120 is connected to the casing string via connectors, such as those shown as 145 and 146.

FIG. 6*a* shows the closed sleeve or closed port position. In this position, the sleeve 130 may be secured against the mechanical casing collar 105 using shear pins 165 or other fasteners, by interlocking or mating with a profile on the inner surface of the casing collar, or by other suitable means. Once the casing collar locator 105 is engaged, sealing element 85 can be set against sliding sleeve 130, aided by mechanical slips 90. The set seal isolates the wellbore above the ported sub of interest. In this position, no fluid communication across the port 135 is possible.

FIG. 6*b* shows the open sleeve or open port position. In this position, the sleeve 130 has shifted downward, such that it is no longer disposed over port 135. To actuate the sleeve 130 from a closed to an open position, a downward force and/or pressure applied to the tool string 80 (and thereby to sliding sleeve 130) from the surface. This force drives sleeve 130 in the downward direction, shearing pin 165, and sliding the sleeve downward so as to open port 135. If locking of the sleeve in the port open position is desired sleeve 130 has been shifted, a lockdown, snap ring 160, collet, or other engagement device may be secured about the outer circumference of the sleeve 130. A corresponding trap ring 170 having a profile, groove, or trap to engage the snap ring 160, is appropriately positioned within the housing so as to engage the snap ring once the sleeve has shifted, holding the sleeve open.

Once sleeve 130 is shifted and ports 135 are open, treatment may be applied to the formation. As noted previously, the tool string 80 includes a jet fluid assembly which may be a jet perforation device.

Figure 5:
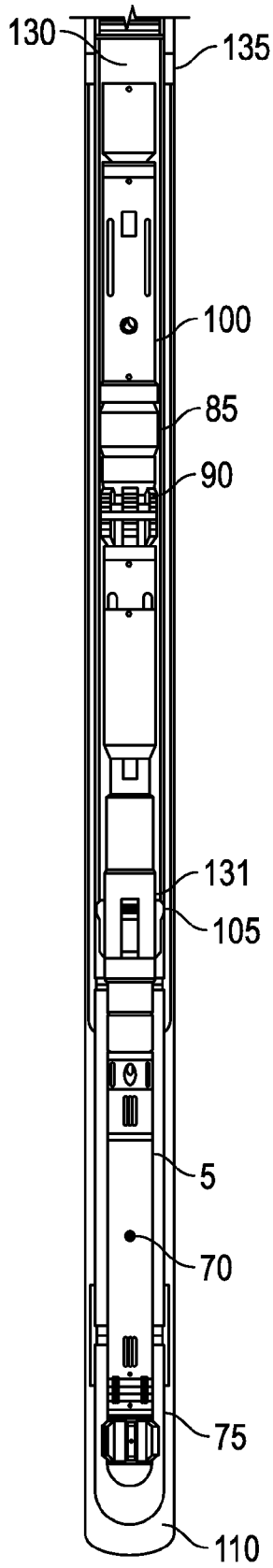
FIG. 5 illustrates a schematic view of a tool string which includes a depressurization tool deployed in a casing string with a sliding sleeve according to one embodiment.

FIG. 5 schematically shows a tool string 80, which includes depressurization tool 5 deployed within a wellbore that includes a casing 75. The casing 75 is made up of multiple lengths of casing or tubing, forming a casing string, the casing string including ported sub 120. When the sliding sleeve 130 is in the port closed position, the lower end 131 of sliding sleeve 130 is positioned over the mechanical collar locator 105. The depressurization tool 5 is located below the mechanical collar locator 105 and below sliding sleeve 130. Sealing element 85 can be sealed against sleeve 130, thereby defining an isolated wellbore segment between sealing element 85 and the bottom of the wellbore.

Operation

It is believed the depressurization tool will typically be used in relieving excessive hydraulic pressure within an isolated wellbore zone. The isolated zone may be in a cased or open hole well, may be a zone that is isolated on either end by a sealing element, or a zone that is temporarily or permanently closed at the bottom of the zone but temporarily closed at the top of the zone. For example, the isolation may be provided at the lower end by cement, a bridge plug, sand plug, other blockage or by a sealing element carried on a tool string. The isolation at the uphole end of the zone will typically be provided by an actuable sealing element.

Many sealing devices are actuated by physical manipulation of the tool assembly within the well. As such, the process of setting of the sealing element may cause compression of fluid within the wellbore segment below the seal. In some cases, full setting of the sealing device is resisted by a buildup of hydraulic pressure in the wellbore below the sealing device. Such resistance may be sufficient to prevent full actuation of the sealing device.

Accordingly, in some embodiments, the seal is initially set sufficiently during the initial stages of actuation to prevent fluid passage past the sealing element, and as pressure builds during continued actuation of the seal, the threshold pressure required to open the closure on the opening of the decompression chamber will be exceeded. Thus, during the seal actuation process, the decompression chamber will be opened to dissipate the fluid pressure within the isolated wellbore, allowing full actuation of the sealing device.

When using this method to set the seal and subsequently actuate a sliding sleeve, a problem may arise when the wellbore beneath the sliding sleeve is impermeable to fluid dissipation. When the sealing element effectively seals within the sliding sleeve, the wellbore beneath the seal becomes isolated from the wellbore above the seal. When the sealing element 85 is set within the lowermost sleeve of a casing string of a wellbore with a cemented casing, a fixed wellbore volume is created below the seal.

As another example, a bridge plug or other seal may be present below the engaged sleeve and below the depressurization tool, creating a fixed volume between the seal of the tool assembly and the bridge plug or other lower seal. Subsequently, when additional fluid pressure is applied to the wellbore above the seal to shift the tool string and sleeve downward, the sleeve cannot be fully shifted due to the pressure of the fluid present below the seal, which cannot escape through any lower perforation or permeable portion of the well or formation.

Accordingly, sliding sleeves are not typically used in the lowermost treatment interval of a wellbore, which is instead typically perforated using a separate tool assembly, requiring an additional trip in and out of the well. The ability to fully set a packer and/or to open a port within the toe of a cased well, rather than having to perforate this lowermost interval, provides significant time, fluid, and cost savings in completing the well.

Referring to FIGS. 5, 6*a*, 6*b*, 7*a* and 7*b*, when the depressurization tool 5 is present in tool string 80, a sleeve 130 within the wellbore 12 may be shifted even when the wellbore below the sleeve has a fixed and isolated volume. In this case, the decompression chamber 10 provides additional wellbore volume to allow decompression of wellbore fluid present within the isolated wellbore segment. When the tool string 80 is lowered downhole, sealing element 85 is engaged against the sliding sleeve 130. Decompression chamber 10 is positioned below sleeve 130 and below sealing element 85. When so positioned, the volume of annulus 2 is decreased, the space instead being occupied by decompression chamber 10.

Once the sealing element 85 is effectively set against sliding sleeve 130 (in response to force applied from the surface), the volume of fluid remaining within the wellbore annulus 2 in the isolated segment (i.e. the segment below the seal) is minimal in comparison with the volume of the decompression chamber 10. Fluid pressure applied to the wellbore above the sealing element 85 will apply a downhole force against sliding sleeve 130. As the downhole force increases, the sleeve 130 will slide downward, away from its position over port 125. The hydraulic pressure below the sleeve will also increase significantly due to the minimal volume of the annulus 2 below sealing element 85, making it difficult to completely actuate the sleeve 130.

The burst disc 70 of decompression chamber 10 is designed to open at a threshold pressure. Thus, when the pressure below the sleeve is increased, the burst disc 70 will burst-opening the decompression chamber 10 and allowing the pressurized fluid from the isolated wellbore annulus 2 to enter the comparatively low pressure environment of the chamber interior 15. The internal volume 15 of the chamber 10 is greater than the volume of fluid within the isolated annulus 2 prior to rupture of burst disc 70. Accordingly, once the decompression chamber 10 has been opened, the fluid pressure below the sealing device 85 is thereby dissipated and sleeve 130 can travel its full sliding distance, opening the port 125 for fluid treatment of the wellbore in that region.

EXAMPLE

Stage Cementing Application

As in the above example, stage cementing involves opening of a valve or sliding sleeve downhole. A casing is lowered into a wellbore and lengths of casing are connected by valves, which are used to deliver cement in stages to the annulus outside of the casing. Cement may then be circulated from the wellbore to the annulus through the valves in stages. Stage valves generally remain closed until cementing has progressed within the annulus to the height of the valve. The valves can be mechanically or hydraulically actuated.

The above-described embodiments of the present invention are intended to be examples only. Alterations, modifications and variations may be effected to the particular embodiments by those of skill in the art without departing from the scope of the invention, which is defined by the claims appended hereto.

What is claimed is:

1. A method for dissipating hydraulic pressure within an isolated zone of a wellbore, the method comprising:

deploying a tool string into the wellbore, the tool string comprising a sealing device disposed on the tool string and a decompression chamber disposed on the tool string below the sealing device, the decompression chamber having an upper end adapted for connection to the tool string, the chamber defining a hollow interior and having an opening for admitting fluid from an annulus defined between the wellbore and the tool string into the interior of the chamber, the opening being sealed by a closure configured to isolate the chamber from the annulus defined between the wellbore and the tool string, the closure being openable in response to a predetermined fluid pressure differential between the annulus and the decompression chamber;

lowering the tool string within the wellbore to locate the decompression chamber within the bottom of the wellbore;

actuating the sealing device to hydraulically seal the wellbore region below the sealing device from the wellbore region above the sealing device and thereby form an isolated zone below the sealing device;

effecting a wellbore operation while the isolated zone remains hydraulically isolated, the wellbore operation comprising raising the hydraulic pressure within the isolated zone such that the predetermined fluid pressure differential between the annulus and the decompression chamber is exceeded and the closure opens; and collecting wellbore fluid from the isolated zone within the decompression chamber, thereby reducing the hydraulic pressure within the isolated zone.

2. The method of claim 1, further comprising deploying the tool string on coiled tubing.

3. The method of claim 1, further comprising lining the wellbore with a casing string comprising a housing with a port defined therethrough and an associated sliding sleeve disposed within the housing; and positioning the tool string adjacent to the sliding sleeve in the casing string.

4. The method of claim 3, wherein reducing the hydraulic pressure allows the movement of the sleeve from a closed position in which the sleeve is positioned over the port to an open position in which fluid communication through the port can occur.

5. A method for actuating a sliding sleeve located in a bottom region of a well bore, the method comprising:

positioning a casing string comprising a housing having at least one port and an inner sliding sleeve disposed within the housing, the sliding sleeve actuable to slide between a first position in which the sliding sleeve is disposed over the port to a second position in which the port is not covered by the sleeve;

deploying a downhole assembly into the casing string, the downhole assembly comprising a decompression chamber, the decompression chamber having a hollow interior and having an opening for admitting fluid from an annulus defined between the wellbore and the tool string into the interior of the chamber, the opening being sealed by a closure configured to isolate the chamber from the annulus defined between the wellbore and the downhole assembly, the closure being openable in response to a predetermined fluid pressure differential between the annulus and the decompression chamber, and a sealing element positioned above the decompression chamber;

setting the sealing element so as to provide a seal between the sleeve and the casing string;

delivering fluid to the wellbore above the sealing element, thereby creating a pressure across the closure sufficient to open the closure;

dissipating wellbore fluid pressure in an annulus below the sealing element by movement of annular fluid to the interior of the decompression chamber; and maintaining the fluid delivery to the wellbore, thereby causing the sleeve to slide from the first position to the second position.

6. The method of claim 5, further comprising carrying out a well treatment operation once the sleeve is in the second position.

* * * * *